United States Patent [19]

Rickert

[11] 4,084,564

[45] Apr. 18, 1978

[54] HEAT EXCHANGER SYSTEM FOR CHARGE FORMING APPARATUS

[75] Inventor: Paul E. Rickert, Oregon, Ohio

[73] Assignee: Borg-Warner Corporation, Chicago, Ill.

[21] Appl. No.: 715,695

[22] Filed: Aug. 19, 1976

Related U.S. Application Data

[63] Continuation of Ser. No. 504,371, Sep. 9, 1974, abandoned.

[51] Int. Cl.[2] ..... F02M 5/10; F02M 15/00

[52] U.S. Cl. ..... 123/139 AV; 123/41.31; 165/51

[58] Field of Search ..... 123/122 E, 134, 139 AV, 123/41.31; 165/51; 261/159

[56] References Cited

U.S. PATENT DOCUMENTS

| | | | |
|---|---|---|---|
| 1,953,809 | 4/1934 | Kennewey | 123/139 AV |
| 2,628,824 | 2/1953 | Brown | 261/159 |
| 3,196,926 | 7/1965 | Gartland | 261/159 |
| 3,223,392 | 12/1965 | Ball | 123/139 AV |
| 3,332,476 | 7/1967 | McDougal | 165/51 |
| 3,593,694 | 7/1971 | Hilborn | 123/139 AV |

*Primary Examiner*—Carroll B. Dority, Jr.
*Assistant Examiner*—David D. Reynolds
*Attorney, Agent, or Firm*—Harry O. Ernsberger

[57] ABSTRACT

The disclosure embraces a fuel system and charge forming apparatus of the float bowl type including a heat exchanger or heat transfer means associated with the charge forming apparatus providing a fuel circulating system or circuit for conveying heat away from the fuel in the charge forming apparatus to maintain the fuel below temperatures at which the fuel readily vaporizes to prevent or minimize "vapor lock" in the fuel bowl and fuel channels of the charge forming apparatus.

21 Claims, 21 Drawing Figures

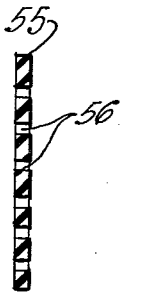
Fig. 11
Fig. 10
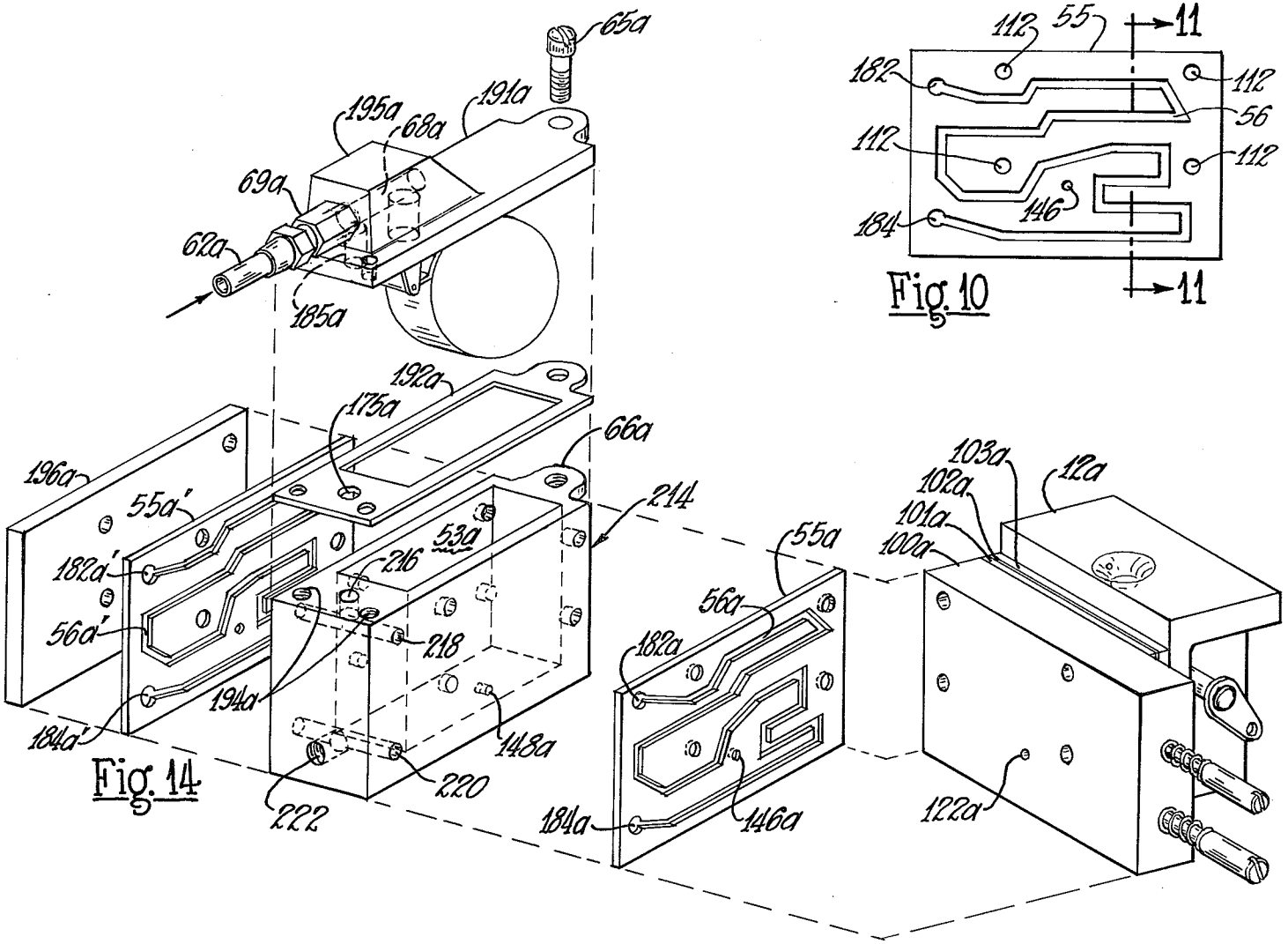
Fig. 14

HEAT EXCHANGER SYSTEM FOR CHARGE FORMING APPARATUS

The invention relates to a charge forming apparatus or carburetor for internal combustion engines and more particularly to a charge forming apparatus or carburetor embodying a fuel circulating system of a character for conveying heat away by the circulating fuel to maintain the fuel in the float bowl and fuel channels of the charge forming apparatus or carburetor at a comparatively low temperature in order to reduce or minimize vaporization or volatilization of the fuel in the charge forming apparatus or carburetor.

It is well known that the charge forming apparatus or carburetor associated with an internal combustion engine is subject to engine heat under certain conditions to an extent that the fuel vaporizes or volatilizes in the fuel bowl and fuel channels of the carburetor fostering a condition usually referred to as "vapor lock" and is likely to occur with automotive vehicle engines where the engine is confined within an engine compartment.

The condition of "vapor lock" tends to occur under several conditions. The temperature in the engine compartment may become excessive during engine idling periods as air flow through the engine compartment during such periods is minimal resulting in "vapor lock". When a thoroughly heated engine is stopped, the residual heat from the engine volatilizes or vaporizes the fuel in the float bowl of the carburetor and often to an extent of vaporizing substantially all of the fuel in the float bowl.

Under such condition, when the internal combustion engine is cranked by an electric starting motor or other means, the fuel delivered by the fuel pump into the heated carburetor is volatilized or vaporized thereby rendering it difficult to start the engine.

The invention embraces the provision of a fuel feed system for an internal combustion engine involving circulating liquid fuel in heat-transferring relation with the charge forming apparatus or carburetor used with the engine for maintaining a comparatively low fuel temperature in the system.

Another object of the invention resides in the provision of a fuel feed system associated with a carburetor or charge forming apparatus for an internal combustion engine wherein liquid fuel is circulated in heat-transferring relation with the receptacle or bowl of a float-type carburetor whereby the receptacle or bowl containing the liquid fuel is maintained at a comparatively low temperature during engine operation to reduce or substantially eliminate vaporization of the fuel in the receptacle or bowl.

Another object of the invention resides in continuously circulating liquid fuel by the fuel pump in heat-transferring relation with the float bowl or fuel receptacle of a carburetor and the circulating fuel returned to the fuel tank or fuel supply for maintaining the fuel in the float bowl or receptacle at a comparatively low temperature.

Another object of the invention is the provision of an arrangement for circulating liquid fuel in heat-exchanging or heat-transferring relation with a fuel receptacle or bowl of a carburetor wherein circulation of the fuel through the heat-exchanging or heat-transferring arrangement does not affect the functioning of the carburetor to supply the fuel requirements of the internal combustion engine.

Another object of the invention resides in a heat-transfer means or heat-exchanger particularly applicable to a modular type carburetor for accommodating circulating liquid fuel wherein the heat-exchanger or heat-transfer means may be embodied in or associated with the fuel bowl of the carburetor without modification or change of the modular components of the carburetor containing fuel and air channels and passages whereby the carburetor functions in a normal manner and the tendency of "vapor lock" substantially reduced or eliminated.

A further object of the invention resides in a fuel feed system wherein liquid fuel is delivered to a carburetor by a fuel pump during operation of the engine starter in cranking the engine for normal engine requirements and excess fuel circulated thereby through a heat-exchanger or heat-transfer means to cool the fuel in the fuel feed system of the carburetor to a reduced temperature.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which:

FIG. 10 is an elevational view of the heat-exchanger circuit laminate shown in FIG. 7;

FIG. 11 is a sectional view taken substantially on the line 11—11 of FIG. 10;

FIG. 14 is a view similar to FIG. 12 showing a modified form of passageways for circulating fuel;

Figure 2:
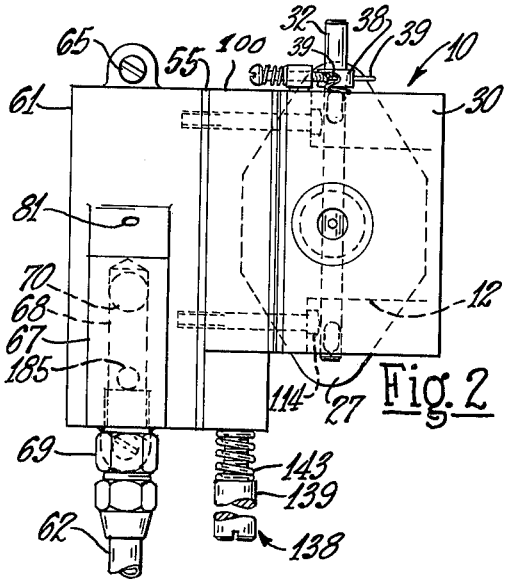
FIG. 2 is a top plan view of the construction shown in FIG. 1.

The heat exchanger or heat-transferring system and arrangement are herein illustrated as associated with or embodied in a float-type carburetor of modular construction, but it is to be understood that the heat exchanger or heat-transferring system and arrangement may be utilized with or embodied in other types of carburetor or charge forming apparatus.

Referring to the drawings in detail, FIGS. 1 through 6 illustrate a charge forming apparatus or carburetor of modular construction wherein the fuel supply is regulated by a float-controlled valve means, the carburetor or charge forming apparatus embodying an arrangement for effecting circulation of fuel in heat-transferring relation with the carburetor fuel bowl or receptacle to convey away heat from the fuel bowl and the fuel contained therein.

The charge forming apparatus or carburetor 10 has a body construction which includes a body, body member or section 12 which is preferably a die casting of metal but which may be cast or molded of other suitable material. The body section or body member 12 is fashioned with a fuel and air mixing passage 14 which is inclusive of an air inlet region or air induction zone 16, a fuel dispersion zone which includes main and supplemental fuel delivery aperture means or orifices, a Venturi configuration 18 and a mixture outlet region 20.

A tubular fitting or member 22 has a flange 23 which is secured to the mixture outlet end of the body member 12 by screws 24, a gasket 25 being disposed between the body member 12 and the flange 23. The hollow interior of the fitting 22 is in registration with the mixture outlet 20. The opposite end of the fitting 22 is provided with a flange 27 having openings 28 to accommodate screws (not shown) for securing the fitting 22 to an intake manifold of an engine. The upper end of the body 12 has a flange 30 for mounting an air filter (not shown) for filtering air entering the mixing passge 14.

Journaled in bores in the body 12 and extending across a cylindrical portion of the mixture outlet passage 20 is a shaft 32 mounting a disc-like throttle valve 34 of conventional construction. An arm member 36 is mounted on the shaft 32 for actuation of the throttle valve 34 by an operator. Also mounted on the shaft 32 is a member or collar 38 equipped with pins 39. The body member 12 has a flange 40 having two threaded openings accommodating respectively adjustable abutment screws 41 and 42. Surrounding the abutment screw 41 and engaging the flange 40 is a coil spring 44 normally under compression for frictionally retaining the abutment screw 41 in adjusted position.

The throttle valve 34 is normally biased toward engine idling position by a coil spring 46, one end 47 engaging the flange 40 and the other end 48 engaging the pin 39. The abutment screw 41 is adapted to be engaged by the pin 39 and may be adjusted to determine the engine idling or near closed position of the throttle valve 34. Engagement of the pin 39 with the abutment screw 42 determines the full open position of the throttle valve 34.

The carburetor body construction includes a body, body section or bowl member 52 providing a fuel chamber or bowl 53 adapted to contain liquid fuel. Associated with the body construction is a fluid flow control system arrangement or construction 54 which is inclusive of a plurality of laminates, laminar members, laminations or components and a heat transfer or heat exchanger laminar member or laminate 55, the latter having a fuel circulating channel 56, these components being disposed between the body members or sections 12 and 52, and illustrated in expanded disassembly in FIG. 7.

The several laminates, laminar members, plates or components of the fluid flow control system have perforate pattern regions or open areas providing fluid flow passages or channels for conveying fuel or air for mixing with fuel or for conveying a fuel and air mixture or emulsion for delivery through aperture means, orifices or nozzles opening into the mixing passage 14. The fluid flow control system and the fuel circulating heat exchanger or heat transfer circuit or system will be hereinafter described in detail.

Figure 1:
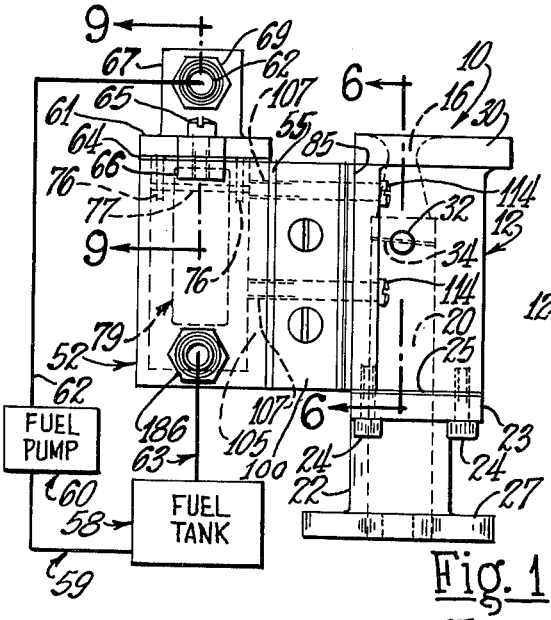
FIG. 1 is a side elevational view of a modular type of charge forming apparatus embodying a form of the invention.

In the embodiment illustrated, liquid fuel is supplied to the carburetor from a fuel supply tank 58 through a tubular means or fuel line 59 to a fuel pump 60, the pump being connected with a cover 61 for the bowl member or body 52 by a fuel conveying means or fuel line 62, as schematically shown in FIG. 1. A fuel conveying means or fuel return line 63 to the fuel tank 58 forming a component of the fuel-circulating heat transfer or heat exchanger circuit is schematically illustrated in FIG. 1.

Figures 7, 8, 9:
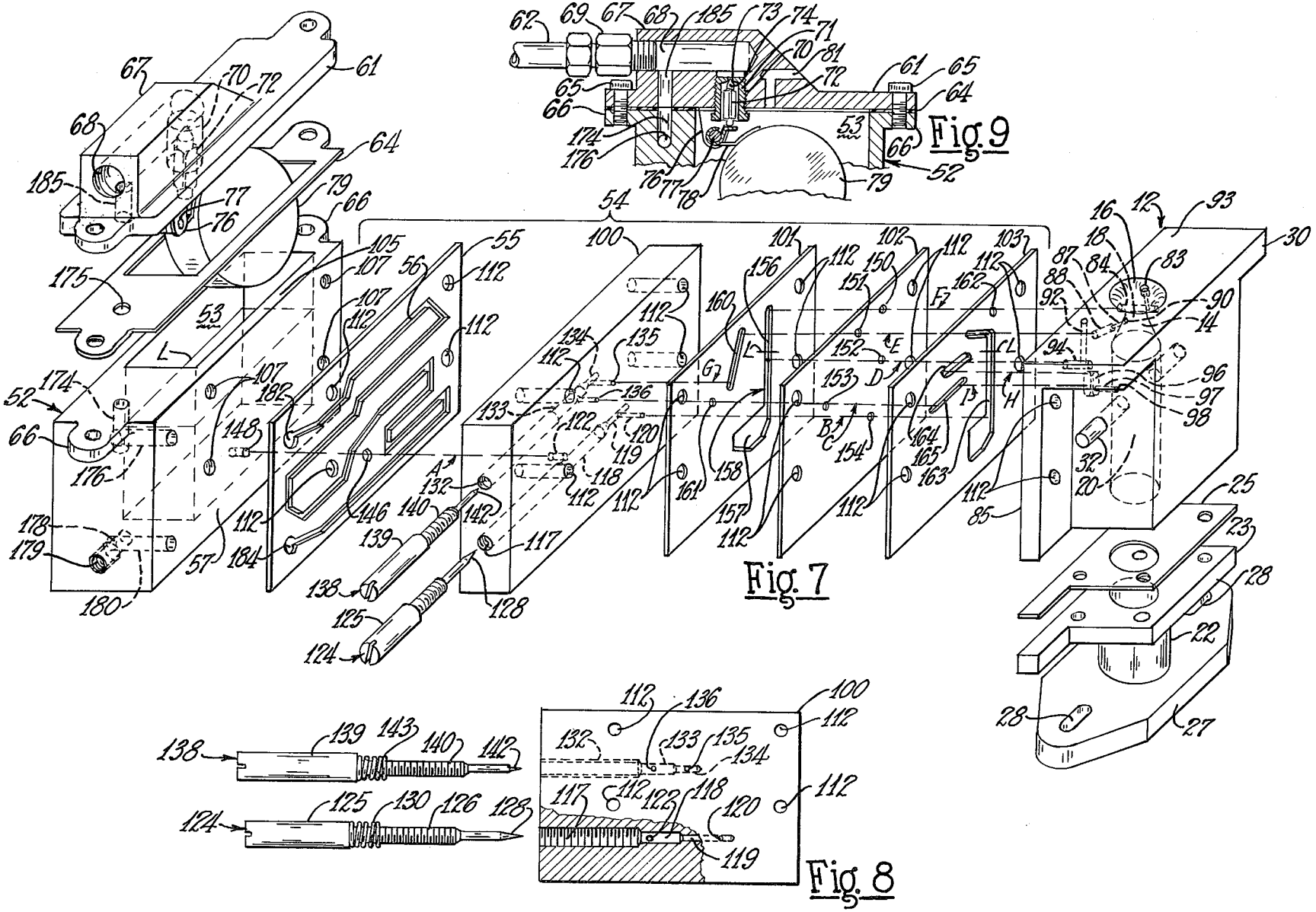
FIG. 7 is an expanded view of the components of the construction shown in FIG. 1.
FIG. 8 is an elevational view, partly in section, of one of the components and associated engine idling and high speed valve constructions illustrated in FIG. 7.
FIG. 9 is a fragmentary sectional view taken substantially on the line 9—9 of FIG. 1.

A gasket 64 is disposed between the upper edges of the walls of the bowl member 52 and the cover member 61, these components being particularly shown in FIGS. 7 and 9. The cover member 61 and gasket 64 are secured in assembled relation, as shown in FIG. 9, by bolts 65 extending through openings in the cover member 61 and the gasket 64 and into threaded openings in projections 66 provided on the bowl member 52.

As particularly shown in FIG. 9, the cover member 61 has a boss portion 67 having a bore or fuel inlet passage 68, threaded at its entrance region to accommodate the fitting 69 connected with the fuel supply line 62. The boss portion 67 is fashioned with a threaded bore 70 in communication with the bore 68, the threaded bore 70 accommodating a valve guide or valve cage 71. The hollow interior of the valve guide 71 accommodates a slidable fuel inlet valve body or member 72 having at its upper end a ledge portion provided with a fuel inlet port 73. The inlet valve body 72 has a needle valve portion 74 cooperating with the fuel port 73 for controlling fuel flow into the fuel chamber 53.

The cover member 61 is provided with a pair of depending ear portions 76, one of which is shown in FIGS. 7 and 9, the ear portions supporting a fulcrum pin 77. An arm or member 78 is fulcrumed on the pin 77, a float member or float 79 disposed in the fuel chamber 53 being secured to the arm 78. Liquid fuel from the fuel pump 60 is supplied under low pressure to the bore 68. When the fuel level is lowered in the fuel chamber 53, the float moves downwardly permitting the valve body 72 to move away from the port 73 whereby fuel flows past the inlet needle valve portion 74 into the fuel chamber 53.

The incoming fuel elevates the float 79 until a ledge portion on member 78 exerts upward force on the valve body 72 to move the needle valve portion 74 into the port 73 to interrupt the flow of fuel into chamber 53 thereby maintaining a substantially predetermined level of fuel in the chamber 53. The fuel chamber 53 is vented by a vent means or passage 81 in the cover member 61.

Figure 6:
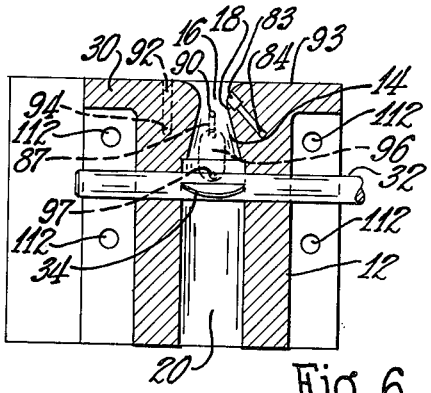
FIG. 6 is a sectional view taken substantially on the line 6—6 of FIG. 1.

Referring to FIGS. 6 and 7, the carburetor body section or member 12 has an air bleed inlet 83 opening into the toroidal-shaped air inlet region 16 of the Venturi 18. The air bleed passage 83 is in communication with a passage 84, the latter opening at the rear face or surface 85 of the body 12. A restricted passage 87 is in communication with a passage 88 which opens at the surface 85. The passage 87 opens into the restricted region or choke band of the Venturi and provides the main fuel delivery orifice or aperture means 90.

An air passage 92 opens at the upper surface 93 of the flange 30. The passage 92 is in communication with a passage 94 opening at the surface 85. An elongated recess or chamber 96 in the body 12 is in communication with a passage 97 which opens into the mixing passage adjacent the throttle valve 34, the outlet of passage 97 being the engine idling fuel delivery aperture means or orifice 98.

Liquid fuel is delivered to the fluid flow control system or arrangement 54 from the fuel supply in the bowl or chamber 53 in the bowl member 52. The fluid flow control system or arrangement 54 includes fluid flow control components, laminar members or laminates 100, 101, 102 and 103 particularly illustrated in FIG. 7 in expanded relation. The laminar members or laminates 100 and 102 are preferably fashioned of metal, such as steel, which is resistant to wear by fluid flowing through passages or perforate areas. The laminates 101 and 103 are preferably made of a fibrous gasket-like material.

The wall 105 of the body 52 is provided with four threaded openings 107, and the body 12 is provided with four openings 112, shown in FIG. 6. The heat-exchanger laminate, gasket or component 55 and each of the laminar members, laminates or components 100, 101, 102 and 103 is provided with four openings 112 as shown in FIG. 7.

Figure 3:
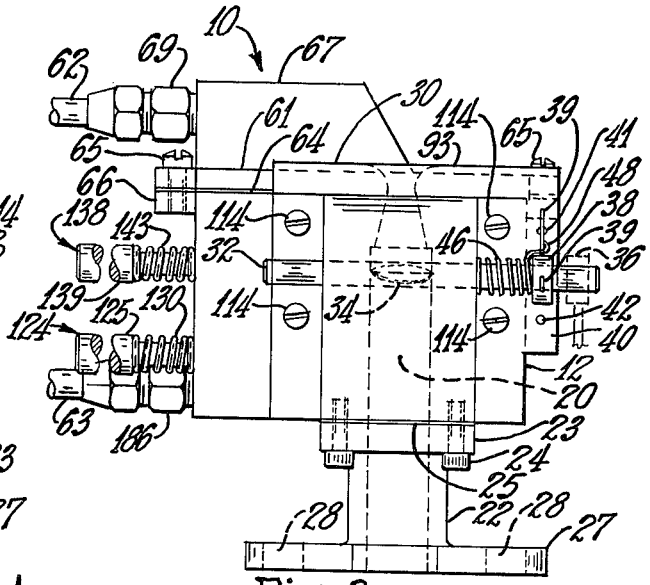
FIG. 3 is a front elevational view of the construction shown in FIG. 1.

When the body members or bodies 12 and 52 are assembled with the heat-exchanger laminate 55 and the four laminates 100, 101, 102 and 103, the openings 112 in the body 12 and in the laminates or laminations and the threaded openings 107 in the body or bowl member 52 are aligned as four groups, each group receiving a threaded member or screw 114, shown in FIGS. 1, 2 and 3, extending into each of the threaded openings 107. The screws 114 secure the body members 12 and 52 and the several laminates in assembled fluid-sealing relation as shown in FIGS. 1 through 3 and 5.

The fluid flow control plates, laminar members or laminates 100 through 103 are fashioned with perforate pattern regions, open areas or passages accommodating fluid flow. Some of the passages accommodate air flow, some accommodate fuel flow and some accommodate a mixture or emulsion of fuel and air depending upon engine operation.

In the embodiment illustrated, the laminate 100 is provided with passages and flow restrictors or valve means for regulating fluid flow. In the arrangement of passages or passage means in the member 100, illustrated in FIGS. 7 and 8, fuel from the supply in chamber 53 flows past a high speed adjustable valve means or restrictor for engine idling, intermediate and high speed requirements.

For engine idling operation, fuel flowing past the high speed adjusting valve means is air bled or mixed with air to form an emulsion, which emulsion is controlled or regulated by an engine idling restrictor or adjustable valve means. The fluid flow control laminate or component 100 has a threaded bore 117 and a bore 118, the bore 118 being in communication with a restricted passage 119 and the latter being in communication with a transverse passage 120.

A transverse passage 122 opens into the bore 118 and receives fuel from the chamber 53 in the member 52. A valve means or restrictor 124 is adapted to regulate fuel flow through the passage 119, the valve means including a valve body 125 having a threaded portion 126 received in the threaded bore 117 in the member 100. The valve body 125 is fashioned with a needle valve portion 128 which, in assembly, extends into the passage 119 for restricting, regulating or adjusting fuel flow through the passage 119. A coil spring 130 surrounding the threaded portion 126 provides friction for retaining the valve means 124 in adjusted position.

The member or laminate 100 has a second threaded bore 132 intersecting a bore 133 which is in communication with a restricted passage 134, the latter intersecting a transverse passage 135. A second transverse passage 136 is in communication with the bore 133. A second valve means or restrictor 138 has a valve body 139 provided with a threaded portion 140 received in the threaded bore 132 and a needle valve portion 142 cooperating with the passage 134 for regulating fluid flow through the passage 134. A coil spring 143 surrounding the threaded portion 140 provides friction retaining the valve means 138 in adjusted position.

Figure 5:
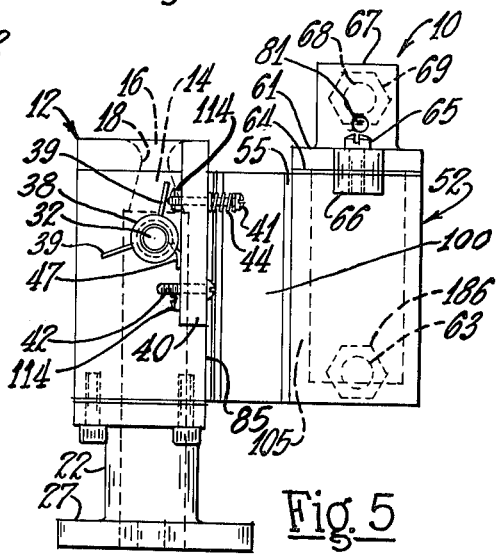
FIG. 5 is a view of the opposite side of the construction shown in FIG. 1.

Disposed between the member or laminate 100 and a planar surface 57 of the wall 105 of the body or bowl member 52 is the heat-transfer or heat-exchanger laminate or gasket 55 which is preferably formed of fibrous gasket material. In assembly, as shown in FIGS. 1, 2 and 5, the heat-exchanger laminate 55 is in contiguous sealing engagement with member 100 and the planar surface 57 of the body section or body member 52.

The heat-exchanger laminate 55 is fashioned with a circuitous open area providing a channel or circuit 56 accommodating circulating liquid fuel for conveying or transferring heat away from the carburetor as hereinafter described. The heat-exchanger laminate 55 is provided with a passage 146, independent of the channel 56, which registers with the passage 122 in the laminate 100 and with a passage 148 in the wall 105 of the body or fuel bowl 52 whereby liquid fuel from the chamber 53 flows through the registering passageways 148, 146 and 122 into the bore 118 in the laminate 100.

The laminate 100 is of a thickness sufficient to accommodate the valve means 124 and 138, being preferably of a thickness of about ⅜ths of an inch or more. The laminate 100 may be a die casting of metal such as an alloy containing aluminum or zinc or may be made of other suitable material. The fluid flow control laminate or component 102 is fashioned with fluid metering perforations or passages and is preferably made of metal such as stainless steel or the like to resist wear by reason of fluid flow through the passages. The passages or perforations in the plate 102 determine fluid flow rates of liquid fuel, air for mixing with the fuel, or a mixture or emulsion of fuel and air.

Disposed between the laminates 100 and 102 is a laminate 101 preferably formed of fibrous gasket material. The laminate 101 has an open area or perforate region comprising a vertically elongated channel 156 in communication at its lower end with a trapezoidal-shaped area 157, the areas 156 and 157 providing a fuel well 158. The laminate 101 is also provided with a channel 160 and a perforation or passage 161.

The region 157 of the fuel well 158 receives fuel from the transverse passage 120 in the laminate 100. Air for bleeding with fuel is admitted to the upper end of the channel 156 of the fuel well to form a fuel and air mixture or emulsion for delivery into the mixing passage 14. The lamination 103 is fashioned with a perforation or passage 162 and elongated fluid flow channels or open areas 163, 164 and 165, the channel 163 being a second or supplemental fuel well.

The several fluid flow paths or passages are indicated by broken lines designated "A", "B", "C", "D", "E", "F", and "G" in FIG. 7. The liquid fuel, air, or an emulsion or mixture of air and fuel traverses one or more of the paths depending upon the speed of the engine. It is to be understood that the sizes and positioning of the perforations or passage areas in the laminates may be modified depending upon the fuel and air mixture requirements of an engine with which the charge forming apparatus or carburetor may be used.

In the fluid flow system or arrangement illustrated in FIG. 7, during engine idling operation, a mixture or emulsion of fuel and air is delivered from the idling orifice 98 into the mixing passage 14, the throttle valve 34 being in near closed or engine idling position. Liquid fuel from the supply in the float bowl or chamber 53 of the body member 52 flows along path "A" through the passage 148 in the wall 105 of the fuel bowl 52, through passage 146 in the heat-transfer laminate 55 and through passage 122 in laminate 100 into the bore 118.

Fuel from the bore 118 flows past the high speed adjusting needle valve or restrictor 128 through passage 119 and transverse passage 120 in the laminate 100. The fuel flows along path "B" from passage 120 through the enlarged portion 157 of the fuel well 158 in laminate 101, thence through passage 154 in the laminate 102 into the enlarged region of a supplemental well 163 in the laminate 103. The normal fuel level is indicated at "L" in the float chamber 53, the vertical channel portion 156 of the fuel well 158 in laminate 101 and in the supplemental well 163 in laminate 103.

During engine idling operation, engine suction or reduced pressure at the engine idling orifice passage 97 is effective to flow air into the passage 83 through passage 84 in the body member 12 along the flow path "F" through passages 162 and 150 into the upper end of the vertical portion 156 of the fuel well 158. The air aspirates fuel from the well portion 156 and the emulsion or mixture of fuel and air flows in a right-hand direction along flow path "D" through passage 152 in laminate 102 and into an intermediate region of the supplemental well 163.

Suction at the engine idling orifice 98 is effective to convey air from the Venturi region through passages 87 and 88 to the upper end of the supplemental well 163 for mixing with the emulsion from passage 152. The flowing air is effective in the upper end of the supplemental well 163 to aspirate fuel from the well 163, the resulting mixture of fuel and air or emulsion flowing in a left-hand direction along path "E" through passage 151 in the laminate 102 into and through the elongated passage 160 in laminate 101 thence along path "G" through passage 135 in laminate 100 into passage 134 and past the adjustable engine idling needle valve 142 into the bore 133 and through passage 136.

The mixture or emulsion from passage 136 flows in a right-hand direction along flow path "C" through passage 161 in laminate 101, passage 153 in laminate 102 into the elongated passage 165 in laminate 103, thence along path "I" into the vertically elongated recess or slot 96 in the body 12. Additional air for leaning the engine idling emulsion or fuel and air mixture is provided as follows: Reduced pressure or suction in the recess 96 effects air flow into and through the vertical air bleed passage 92 in the body 12, through passage 94 in a left-hand direction to the elongated passage 164 in laminate 103.

The air flows in a right-hand direction from passage 164 along flow path "H" into the recess 96 in the body 12, in which recess the added air is mixed with the fuel and air mixture and the resulting emulsion delivered through passage 97 and orifice 98 into the mixing passage for engine idling.

With reference to FIG. 7, the paths of fluid flow during high speed engine operation are as follows: Substantial reduced pressure or suction in the mixing passage is effective on the main orifice or aperture 87 to aspriate fuel from the fuel chamber 53 through passage 148 in a right-hand direction along path "A" through the passage 148 in the heat-transfer laminate 55 through passage 122 into the bore 118 in the laminate 100.

Fuel from the bore 118 flows past the high speed adjusting needle valve or restrictor 128 through the restricted passage 119 and transverse passage 120 along path "B" into the portion 157 of the fuel well 158 in the laminate 101 and through the passage 154 in the laminate 102 into the supplemental well or fuel channel 163 in laminate 103.

The suction or reduced pressure at the main orifice 90 is effective through the engine idling fuel delivery passage 97 and the recess 96 to cause air flow from the mixing passage through the passage 97 and recess 96 in a left-hand direction along path "I" into the elongated passage 165 in laminate 103, thence in a left-hand direction along path "C" through passage 153 in laminate 102, passage 161 in laminate 101, passage 136 in laminate 100 into the bore 133, past the engine idling adjustable needle valve or restrictor 142 through the restricted passage 134, through passage 135 along path "G" in a right-hand direction into the elongated passage 160 in the laminate 101.

Air from the passage 160 flows in a right-hand direction along path "E" through passage 151 in laminate 102 into the upper end of the supplemental well 163 in laminate 103. The air flowing into the upper region of the well 163 mixes with fuel in the well whereby a fuel and air mixture or emulsion flows through passage 88 in the body 12 and is discharged into the Venturi 18 through the main orifice or aperture 90.

Additional air bleeding of the fuel mixture for delivery from the main nozzle 90 is accomplished as follows: Aspiration or suction at the main orifice 90 causes air flow into the passage 93 and through passage 84, thence in a left-hand direction along path "F" through passage 162 in laminate 103, passage 150 in laminate 102 into the upper region 156 of the fuel well 158.

Air flowing through the upper region of the well portion 156 aspirates fuel from the well 158 providing a fuel and air mixture which flows in a right-hand direction along path "D" through the metering orifice 152 in laminate 102 into the supplemental well 163. Thus, air flowing from the passage 160 in the laminate 101 and through passage 151 along path "E" further air bleeds the fuel and air mixture flowing from the upper portion of the supplemental well 163 into the passage 88 in the body 12, thence through the passage 87 and is delivered through the main orifice 90 into the Venturi 18 of the mixing passage 14.

As the engine increases in speed, the fuel in the wells 158 and 163 may be lowered by aspiration of the fuel by air flow as above described. Air entering the passage 83 in the entrance ramp of the Venturi flows into the upper well portion 156 mixing with fuel to promote acceleration as the throttle is moved toward open position. The passage 152 in the metering laminate 102 is effective to introduce air into the well 163 when the level of the fuel in the wells 158 and 163 falls appreciably at open throttle engine operation.

The reduced pressure or suction at the idle mixture delivery orifice 98 during high speed engine operation is effective to establish some air flow in the passage 92 in the body 12 through passage 94 in a left-hand direction into the passage 164 in the laminate 103. Air from passage 164 then flows in a right-hand direction along path "H" into the recess 96, this action functioning to stabilize air flow at the region of the recess 96.

The metering characteristics of the carburetor or charge forming apparatus may be varied or modified by employing fluid flow control laminates or components having perforations, passages or wells of different cross sectional areas to modify or vary the flow of both fuel and air or a mixture or emulsion of fuel and air. The cross sectional areas of openings or passages in one or more laminates may be varied by changing the perforate pattern regions, the widths of open areas or passages, or by utilizing laminations of different thicknesses.

The laminates 101, 102 and 103 are preferably comparatively thin being of a thickness in a range of fifteen thousandths of an inch and eighty thousandths of an inch or more. The component or laminate 100 is of greater thickness to accommodate the adjustable needle valves or restrictors 124 and 138. It is preferred that the laminate 100 be of a thickness in a range of from about five sixteenths of an inch to one-half of an inch, the thickness being dependent upon the diameters of the threaded portions 126 and 140 of the restrictors.

It is preferred that the metering laminate 102 be fashioned of stainless steel or the like in order to resist wear of fluid flow through the passages. The laminates 101 and 103 are preferably formed of suitable fibrous gasket material or other suitable material of a character to establish fluid-tight seals with the adjacent laminates. Where the carburetor is of a larger size and of increased flow capacity, the dimensions of the fluid flow control laminates or components and the flow passages therein may be modified to accommodate the increased fluid flow.

It is to be understood that interchangeable laminates may be utilized so as to vary, change or modify the fluid flow or metering characteristics of a particular carburetor. Through the use of interchangeable laminates, the metering or fluid flow characteristics of a carburetor may be varied within wide limits simply by interchanging one or more laminates having perforate regions or open areas of different configurations or cross sections.

Associated with or embodied in the carburetor hereinbefore described is a system and arrangement for effecting continuous circulation of liquid fuel in heat-transferring relation with the fuel bowl 52 and fuel in the chamber 53 of the carburetor for conveying away heat from the fuel bowl to maintain the fuel in the bowl at a reduced temperature to substantially eliminate or minimize the tendency of the fuel in the carburetor to be vaporized or volatilized by heat from the engine.

The heat transfer or heat exchanger system and arrangement utilize excess fuel supplied by the fuel pump for circulation in heat-transferring relation with the float bowl, the circulating fuel being returned to the fuel tank in order to convey away and dissipate heat transferred from the fuel bowl of the carburetor to the circulating fuel.

The heat transfer or heat exchanger laminar means, member or laminate 55, disposed between the fuel bowl or member 52 and the laminate 100, is preferably fashioned of fibrous gasket material with an elongated circuitous, undulated or serpentine-like channel 56 which may be formed by a blanking die, the channel 56 forming a component of a fuel circulating circuit or system of the invention associated with the charge forming apparatus. The heat transfer laminate 55 is of planar shape so as to engage the planar or flat surface 57 of the fuel bowl 52 and the adjacent planar or flat surface of the laminate 100 as in the assembly shown in FIGS. 1, 2, 5 and 7. The fuel flow capacity of the channel 56 may be varied by modifying the cross sectional area of the channel by employing a laminate 55 of different thickness or by changing the width of the channel. The thickness of the laminate 55 is usually in a range of one sixty-fourth of an inch and one-eighth of an inch.

Figure 4:
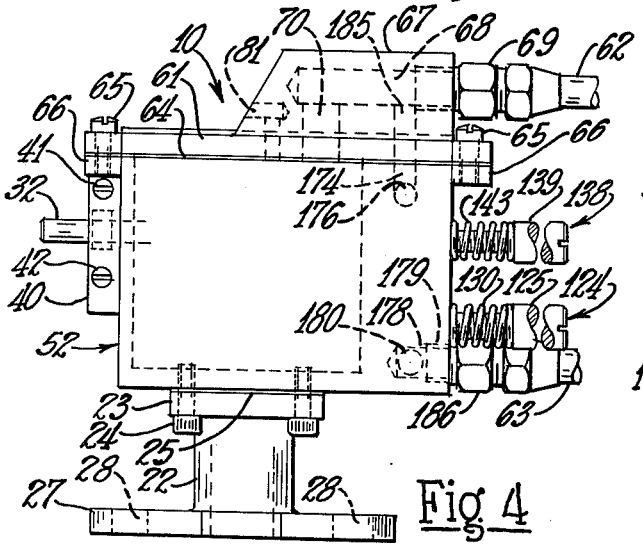
FIG. 4 is a rear elevational view of the construction shown in FIG. 1.

With particular reference to FIGS. 4, 7 and 9, the body or bowl member 52 is provided with a vertical bore 174 which is in communication with a transverse bore 176 in the member 52, the bore 176 opening at the flat surface 57. The lower end region of member 52 is provided with a substantially horizontal bore 178 having a threaded entrance region 179, the bore 178 being in communication with a transverse bore 180 which opens at the surface 57. One end of the channel 56 in the laminate 55 has a circular end region 182, and the opposite end of the channel 56 has a circular end region 184.

In assembly of the laminate 55 in contiguous engagement with the surface 57 of member 52, the circular end region 182 is in registration with the passage 176, and the circular end region 184 is in registration with the passage 180. The planar laminate 55 is in contiguous sealing engagement with the adjacent planar surface of the laminate 100. Thus, the surface 57 of member 52 and the planar surface of the laminate 100 provide side walls for the channel 56 so that a continuous circuitous channel 56 is provided from passage 176 to the passage 180.

The float bowl cover 61 is fashioned with a vertical passage 185 which registers with the vertical passage 174 in the member 52 through an opening 175 in the gasket 64. Thus, the bore 68 in the cover member 61 is in communication with the fuel circulating channel 56 through the intercommunicating passages 185, 174 and 176. The fuel return line, tubular means or conduit 63 is connected by a fitting 186, shown in FIGS. 1, 3 and 4, threaded into the threaded region 179 of the bore or passage 178.

The heat exchanger or heat transfer system and arrangement function as follows: The fuel pump 60, in operation, supplies fuel through the tubular means, conduit or fuel line 62 to the inlet or inlet passage 68 in the cover member 61 in an amount in excess of the fuel requirements for the engine, the fuel for the engine contained in the fuel chamber 53 being regulated by the float-controlled valve 73. The fuel pump may be of the character operated from an internal combustion engine cam shaft in a conventional manner whenever the engine crankshaft is rotated either by the engine-starting motor or when the engine is operating.

In certain engine installations, the fuel pump may be of the electrically actuated type which may be operated prior to or concomitantly with the energization of the engine starting motor. An electrically operated fuel pump is usually energized by manipulation of the engine ignition switch prior to energization of the engine starting motor. With either type of fuel pump, fuel is delivered by the pump through the fuel line 62 to the bore 68 before engine operation occurs and continuously during engine operation.

The excess fuel delivered into the bore 68 is continuously circulated by the fuel pump through the circuitous path or channel system provided by passages 185, 174, 176, elongated channel 56, passage 180, the outlet or outlet passage 178 and through the return line 63 to the fuel tank 58. Thus, the liquid fuel flowing continuously through the heat exchanger or heat transfer circuit or system during engine operation conveys heat away from the carburetor construction and particularly away from the bowl member 52 and fuel contained in the bowl or chamber 53, the heat absorbed by the cooling circuit being dissipated along the fuel return line or conduit and in the fuel supply tank.

When the engine heat has increased tending to raise the temperature of the fuel in the chamber 53 to an extent that would promote vaporization or volatilization of the fuel in the float bowl member 52, the liquid fuel circulating through the heat exchanger or heat transfer system, being of a lower temperature, will maintain a reduced temperature of the bowl member 52 and the fuel contained therein principally through conduction of heat through the wall 105.

As a substantial amount of the fuel pumped to the carburetor by the fuel pump is continually circulated during engine operation and returned to the fuel tank 58, the temperature of the fuel in the chamber 53 of the fuel bowl will approximate the temperature of the fuel in the fuel tank. Hence, the maintenance of a comparatively low temperature of the fuel in the chamber 53 substantially eliminates or minimizes the tendency for "vapor lock" to occur.

When a thoroughly heated engine is stopped and the fuel pump ceases to operate, the heat from the engine may vaporize some or a substantial portion of the residual fuel in the float bowl or chamber 53. When the operator endeavors to restart the heated engine, the fuel vapor in the fuel bowl or chamber 53 may form "vapor lock" preventing the delivery of liquid fuel through the fuel channels into the mixing passage 14.

As the engine crankshaft is rotated by the engine-starting motor, the fuel pump is functioning to pump fuel to the bore 68 and through the heat-exchanger of heat-transfer circuit whereby the circulating fuel conducts heat away from the body or bowl member 52 and thereby cooling or reducing the temperature of the body member and the chamber 53 so that liquid fuel may be pumped into the chamber 53 enabling starting of the heated engine in a comparatively short period of time.

Under engine idling conditions, the continuously circulating fuel through the channel 56 and associated passages of the heat-exchanger system conveys heat away from the body 52 to thereby maintain the chamber 53 at a reduced temperature sufficient to preclude vaporization of the fuel in chamber 53 and hence prevent "vapor lock". During normal engine operation, the continuously circulating liquid fuel through the heat-exchanger or heat-transfer circuit maintains the liquid fuel in the chamber 53 at a temperature below its vaporization point.

Figures 12, 13:
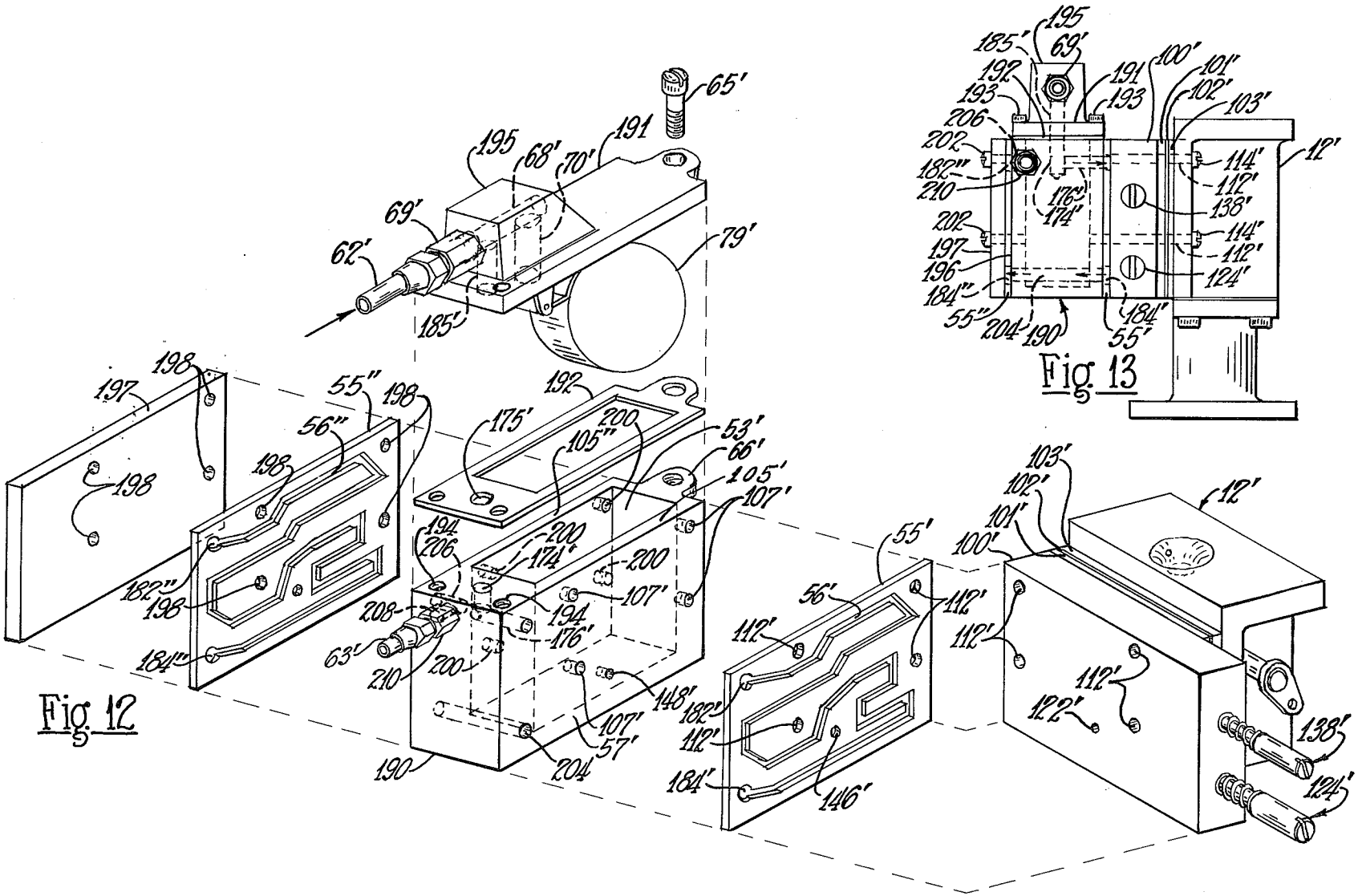
FIG. 12 is an expanded view illustrating a carburetor arrangement embodying two heat-exchanger circuit laminates.
FIG. 13 is an end view of several of the components shown in FIG. 12 in assembled relation.

FIGS. 12 and 13 illustrate a modification of the heat-exchanger or heat-transfer system and arrangement of the invention. In this form of the invention, several of the carburetor components or members may be the same as the corresponding components of the carburetor construction illustrated in FIGS. 1 through 9. The body member 12' and the laminates or laminations 100', 101', 102' and 103' are of the same construction as the corresponding components hereinbefore described and illustrated in FIGS. 1 through 8.

The cover member 191 is of modified configuration but the float 79' and the float-controlled fuel inlet valve arrangement are of the character illustrated in FIG. 9. The laminate or component 100' is equipped with a high speed fuel adjusting valve or restrictor 124' and an engine idling mixture adjusting valve or restrictor 138'. The body member or body component 190 is of a configuration similar to that of the body or bowl member 52 hereinbefore described.

In the arrangement shown in FIGS. 12 and 13, a heat-exchanger or heat-transfer member or laminate is provided for each side of the body member 190, the latter being shaped to provide a fuel chamber 53' of the same configuration as the fuel chamber 53. Arranged at the right-hand side wall surface 57' of the body member or fuel bowl 190 is a heat-exchanger laminate or gasket 55' of the same configuration as the laminate or gasket 55.

Arranged adjacent and contiguous with the opposite planar side surface of the fuel bowl 190 is a second heat-exchanger, member, laminate or gasket 55'' of the same character as the laminate 55'. The laminate 55' is fashioned with a circuitous channel or open area 56' for accommodating circulating liquid fuel, and the second heat-exchanger or laminate 55'' is fashioned with a circuitous channel or open area 56'' for accommodating circulating liquid fuel. The ends of the channel 56' terminate in circular open areas 182' and 184', and the ends of the channel 56'' terminate in circular areas 182'' and 184''.

The body member 12' and each of the laminates 55', 100', 101', 102' and 103' is fashioned with four openings 112', the openings being shown in the laminates 55' and 100' in FIG. 12. The wall 105' of the body or bowl member 190 is fashioned with four threaded openings 107'. When the body members or bodies 12' and 190 are assembled with the laminates 55', 100', 101', 102' and 103', as shown in FIG. 13, the four openings 112' in the body 12' and those in the laminates are aligned with the threaded openings 107'.

Each group of openings 112' accommodates a screw 114', two of which are shown in FIG. 13, the screws being received in the four threaded openings 107' in the body member 190. The screws 114' secure the body members 12' and 190 and the laminates 55', 100', 101', 102' and 103' in assembled fluid-tight relation, as shown in FIG. 13.

The bowl cover 191 and the components carried thereby are assembled with the bowl or body member 190 in a manner similar to that illustrated in FIG. 9, a gasket 192 being disposed between the cover 191 and the member 190. These members are secured in assembled relation by a screw 65' and by two screws 193 extending through registering openings in the cover member 191 and the gasket 192, the screws extending into threaded openings 194 in the member 190.

Liquid fuel from the fuel pump flows through the line or tubular member 62' through the fitting 69' into the bore 68' in the boss 195 on the cover member 191 and past the float-controlled needle valve, such as shown in FIG. 9, into the bowl or chamber 53'. Fuel for delivery into the mixing passage in the body or body member 12' flows from the chamber 53' through passage 148' in a wall of the bowl or body 190, through a passage 146' in the heat-transfer laminate 55' and through passage 122' in the laminate 100', thence through the various passages and channels in the laminates 101', 102' and 103' and body 12' as hereinbefore described in reference to the arrangement illustrated in FIG. 7.

A second heat exchanger laminate or heat transfer member 55'' engages the opposite planar or flat wall surface 196 of the bowl member 190 and is secured in position by a plate, laminate or member 197. The plate 197 and the heat exchanger laminate 55'' are each provided with four openings 198, and the adjacent side wall of the bowl or body member 190 is provided with threaded openings 200. Screws 202, shown in FIG. 13, extend through the openings 198 in the laminate 55'' and the plate 197 into the threaded openings 200 to secure the plate 197, laminate 55'' and body member 190 in fluid-tight relation, as shown in FIG. 13.

The arrangement illustrated in FIGS. 12 and 13 provides for the circulation of liquid fuel through the channels 56' and 56'' of the heat exchanger gaskets or laminates 55' and 55'' in series relation. The body member 190 providing the fuel chamber 53' is fashioned with a vertical passage 174' which registers with passage 185' in the cover member 191 through an opening 175' in the gasket 192. The passage 174' in the fuel bowl 190 is in communication with a transversely extending passage 176', the passage 176' registering with the circular end region 182' of the channel 56' of the heat exchanger laminate 55' when the body member 190 and laminate 55' are in assembled relation.

The bowl or body member 190 is fashioned with a second transverse passage 204 extending entirely through the width of the member 190. In assembled relation of the laminates 55' and 55'' with the bowl member 190, the circular open area 184' in the laminate 55' and the circular open area 184'' of the channel 56'' in the laminate 55'' are in registration with the passage 204 in the member 190. The bowl member 190 is fashioned with a short transverse passage 206 which is aligned with, but not in communication with, the transverse passage 176'.

The bowl member 190 is fashioned with a second short passage 208 in communication with passage 206, passage 208 being threaded to accommodate a fitting 210 connected with the return line 63' which conveys circulating fuel into the fuel tank 58, shown schematically in FIG. 1. In the arrangement shown in FIG. 12, the heat-exchanger laminate 55' is substantially identical with the second heat-exchanger laminate 55'', the laminates being of the character illustrated in FIGS. 7, 10 and 11 and hereinbefore described.

When the laminate 55'' and plate 197 are assembled with the bowl member 190, a planar surface of the plate 197 is contiguous with the adjacent planar surface of the laminate 55'', and the opposite planar surface of the laminate 55'' is contiguous with the adjacent wall surface of the bowl member 190 whereby the member 190 and plate 197 provide the side walls for the channel 56''.

The heat-exchanger system and arrangement illustrated in FIGS. 12 and 13 accommodates continuously circulating liquid fuel supplied by the fuel pump 60, schematically illustrated in FIG. 1, the fuel pump being connected with the fuel supply line 62', and the latter connected by a fitting 69' with the bore 68' in the boss portion 195 of the cover member 191. Fuel for delivery into the mixing passage in the body member 12' is supplied from the bore 68' past a float-controlled valve arrangement mounted in a threaded bore 70' in the manner hereinbefore described in connection with FIG. 9.

The excess fuel supplied by the fuel pump flows from the bore 68' through passage 185', through an opening in the gasket 192, through passages 174' and 176' into the circular terminus 182' of the circuitous channel 56' in the laminate 55'. Fuel flows through the channel 56' to the other circular terminus 184' thence through passage 204 in the bowl member 190 into the circular terminus 184'' of the channel 56'' in the second heat-exchanger laminate 55''.

The liquid fuel flows through the circuitous channel 56'' to the circular end terminus 182''. The circular terminus 182'' is in registration with the short passage 208 which is in communication with the fitting 210. The fuel flows through the fitting 210 and the return fuel line 63' into the fuel tank 58, illustrated schematically in FIG. 1.

Thus, it will be apparent that the liquid fuel supplied to the inlet passage or bore 68' in excess of the engine requirements is continuously circulated through the channel 56' in the heat exchanger laminate 55' thence through the channel 56'' in series relation with the channel 56' and through the return line 63' into the fuel tank.

As the respective heat exchanger laminates 55' and 55'' are in fluid-sealing contiguous engagement with the planar sides of the body section or fuel bowl 190, heat is transferred or conducted from the fuel bowl and the fuel contained in the chamber 53' to the circulating fuel in the channels 56' and 56'', the heat being conveyed away by the circulating fuel from the carburetor, thus cooling the float bowl and the fuel contained in chamber 53' thereby eliminating or substantially reducing vaporization of fuel in the chamber 53' and preventing "vapor lock".

By reason of the substantial length of the path for the circulating fuel provided by the circuitous undulated channels 56' and 56'' in series relation, a substantial amount of heat may be conveyed away from the bowl member 190 and the fuel in the chamber 53'.

FIG. 14 illustrates a heat-exchanger system and arrangement similar to that shown in FIG. 12 but wherein the circulating liquid fuel flows through the channels in the heat-exchanger laminates in parallel paths. In this arrangement the body member **12*a* and its associated components, including the laminates 100*a*, 101*a*, 102*a* and 103*a*, the cover member 191*a* and components mounted by the cover 191*a* are the same as the corresponding components shown in FIGS. 12 and 13** and hereinbefore described.

In the arrangement illustrated in FIG. 14, the heat-exchanger or heat-transfer laminates 55*a* and 55*a'*, fashioned respectively with circuitous fuel flow channels 56*a* and 56*a'*, are substantially identical and are of the character shown in FIGS. 7, 10, 11 and 12. The body or bowl member 214 is similar to the configuration of the bowl member 190 shown in FIGS. 12 and 13.

The bowl cover 191*a* is secured at one end of the member 214 by a screw 65*a* which extends through openings in the cover 191*a* and gasket 192*a* into a threaded opening 66*a* in the bowl member. The other end of the cover member 191*a* is secured by two screws, such as the screws 193 in FIG. 13, extending through registering openings in the cover 191*a* and gasket 192*a* and threaded into openings 194*a* in the bowl member 214.

The bowl member 214 is provided with a vertical passage 216 which intersects and is in communication with a transverse passage 218 extending the full width of the bowl member 214. The passage 216 registers with the passage 185*a* in the boss 195*a* on the cover 191*a* through an opening 175*a* in the gasket 192*a*. The passage 185*a* receives fuel from the bore 68*a*, the latter receiving fuel from the fuel pump through the fuel line 62*a* through the fitting 69*a*. The transverse passage 218 is in registration with the circular end region 182*a* of the channel 56*a* in the heat-exchanger laminate 55*a*, and with the circular end region 182*a'* of the channel 56*a'* in the heat-exchanger laminate 55*a'*.

The body or bowl member 214 is fashioned with a second transverse passage 220 extending full width of the member 214. The passage 220 is in registration with the circular end region 184*a* of the channel 56*a* in the heat-exchanger laminate 55*a*, and in registration with the circular end region 184*a'* of the channel 56*a'* in the heat-exchanger laminate 55*a'*. One end region of the body or bowl member 214 has a threaded bore 222 intersecting the transverse bore 220. The bore 222 accommodates a fitting, such as the fitting 186 shown in FIG. 4, the fitting being connected with the fuel return line 63 which conveys fuel to the fuel tank 58 shown schematically in FIG. 1.

In assembly, the laminate 55*a* is in contiguous sealing engagement with the adjacent surface of the bowl member 214 and the laminate 100*a*, and the laminate 55*a'* is in contiguous sealing engagement with the opposite side surface of the bowl member 214 and the adjacent surface of the plate 196*a*. The body members 12*a* and 214 and the laminates illustrated in FIG. 14 are secured in assembly by means of screws (not shown) in the manner illustrated in FIG. 13. The planar side surfaces of the body member 214, a surface of the laminate 100*a* and the plate 196*a* form the side walls for the channels 56*a* and 56*a'*.

In the system and arrangement shown in FIG. 14, fuel from the fuel pump is delivered through the fuel line 62*a* and fitting 69*a* into the bore 68*a*. Fuel for the engine requirements flows from the bore 68*a* into the bowl or chamber 53*a*, the fuel flow being regulated by a float-controlled inlet valve arrangement of the character illustrated in FIG. 9.

Fuel from the bowl or chamber 53*a* flows through a passage 148*a* in a wall of the bowl, through passage 146*a* in the heat-exchanger laminate 55*a* and into passage 122*a* in the laminate 100*a* for supplying fuel for delivery through the main and engine idling orifices as described in connection with FIG. 7. The fuel pump supplies an excess of fuel which is continuously circulated through the passage 185*a* in the cover member 191*a*, opening 175*a* in the gasket 192*a* and into the passage 216 in the bowl member 214.

The fuel from the passage 216 flows in both directions in the transverse passage 218 whereby substantially the same amount of fuel is supplied to and circulated through each of the circuitous channels 56*a* and 56*a'* in the heat-exchanger laminates 55*a* and 55*a'*. The fuel circulating in the channels flows through the circular end regions 184*a* and 184*a'* into the passage 220, the fuel then flowing through the threaded bore 222 through a fitting similar to the fitting 186 shown in FIG. 4 and through a fuel return line of the character shown at 63 in FIG. 4 into the fuel tank.

Thus, substantially one-half of the circulating liquid fuel flows through each of the channels 56*a* and 56*a'* to convey away heat from the bowl member 214 and the fuel contained in the chamber 53*a*. By reason of the simultaneous and continuous flow of fuel in parallel paths through the channels 56*a* and 56*a'*, heat is comparatively rapidly conveyed away from the chamber 53*a* thereby eliminating or substantially reducing the tendency for the fuel in the chamber 53*a* to be vaporized.

Figure 17:
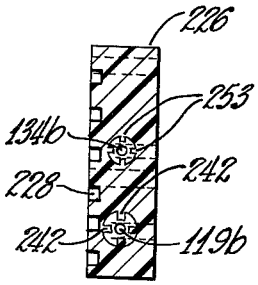
FIG. 17 is a sectional view taken substantially on the line 17—17 of FIG. 16.
Figure 16:
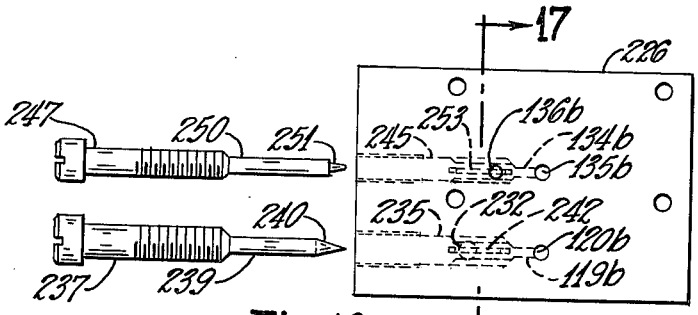
FIG. 16 is an elevational view of the laminate shown in FIG. 17 in association with the fluid regulating valve means.
Figure 15:
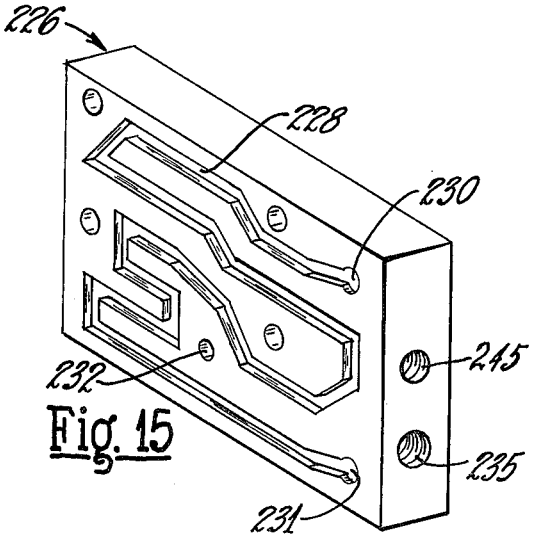
FIG. 15 is an isometric view of a laminate embodying fuel control valve means and a heat-exchanger fluid circuit.

FIGS. 15 through 17 illustrate a modified form of heat exchanger laminar means, laminate or member which is equipped with the engine idling and high speed adjusting valves, and is fashioned with a fuel circulating channel. The laminate 226 may be formed of suitable substantially rigid plastic or resinous material such as Delrin (polyoxymethylene), or Rogers -RX 462 (a fiber-filled phenolic resin) or similar resinous material which has high strength characteristics and is resistant to deterioration by hydrocarbon fuels. As shown in FIGS. 15 and 17, a planar side surface region of the laminate 226 is molded with a circuitous channel 228 of substantially the same contour as the channel 56 shown in the heat exchanger laminate 55 in FIG. 10.

As shown in FIG. 17, the channel 228 is illustrated of a depth substantially equal to the thickness of the laminate 55 shown in FIG. 11, but the width and depth of the channel 228 may be varied depending upon the amount of liquid fuel desired to be circulated through the channel 228. The laminate 226 may be used in lieu of the laminate 100 in FIG. 7 or the laminate 100' shown in FIG. 12 or the laminate 100*a* shown in FIG. 14. Through the use of the molded laminate 226 containing the fuel circulating channel 228, the separate heat exchanger laminate, such as the laminate 55 in FIG. 7, the laminate 55' in FIG. 12 or the laminate 55*a* in FIG. 14, may be eliminated.

The end regions 230 and 231 of the channel 228 may be molded of circular shape for registration with the fuel circulating passages provided in the carburetor bowl members or body constructions 52, 190 and 214 so as to complete a fuel circulating path or circuit as hereinbefore described. The laminate 226 is provided with a fuel flow opening 232 which is adapted to receive fuel from the fuel bowl from a passage, such as the passage 148 shown in FIG. 7, or the passage 148' in FIG. 12 or the passage 148*a* in FIG. 14.

The laminate or member 226 is molded with a bore 235 having a threaded portion which receives the threaded portion of an adjustable valve member 237 for controlling fuel flow for the engine requirements. The passage 232 opens into the bore 235. A bore or passage 119*b* is aligned with the bore 235, the passage 119*b* being in communication with a transverse passage 120*b*.

The valve member 237 is provided with a tenon portion 239 terminating in a needle valve portion 240 which extends into and cooperates with the passage **119*b* for controlling fuel flow in the manner of the adjustable valve member 124 shown in FIGS. 7 and 8**.

The unthreaded portion of the bore 235 is molded with a plurality of inwardly extending projections 242, there being four projections 242 shown in FIGS. 16 and 17. The inner surfaces of the projections are dimensioned to snugly, yet slidably, accommodate the tenon portion 239 of the adjustable valve member 237, the projections functioning to maintain the needle valve portion centrally aligned in the passage **119*b* whereby fuel flows through the annulus thus provided between the needle portion 240 and the entrance of the passage 119*b***.

The laminate 226 is molded with a second bore 245 having a threaded region accommodating the threaded portion of a second adjustable valve means 247. A bore or passage **134*b* is aligned with the bore 245, the passage 134*b* intersecting a transverse passage 135*b*, and the bore 245 intersecting a transverse passage 136*b*. The valve member 247 has a tenon portion 250 terminating in a needle valve portion 251 extending into and cooperating with the passage 134*b* for controlling fuel and air mixture flow as hereinbefore described in connection with the adjustable valve member 138 shown in FIGS. 7 and 8**.

The unthreaded portion of the bore 245 is molded with a plurality of inwardly extending projections 253, there being four projections 253 in the arrangement shown in FIGS. 16 and 17. The inner surfaces of the projections 253 are dimensioned to snugly, yet slidably, accommodate the tenon portion 250 of the adjustable valve member 247, the projections functioning to maintain the needle valve portion centrally aligned in the cooperating passage **134*b*. If desired, the laminate 226** may be molded or cast as a die casting of metal, such as aluminum or zinc or alloys of these metals.

Figure 18:
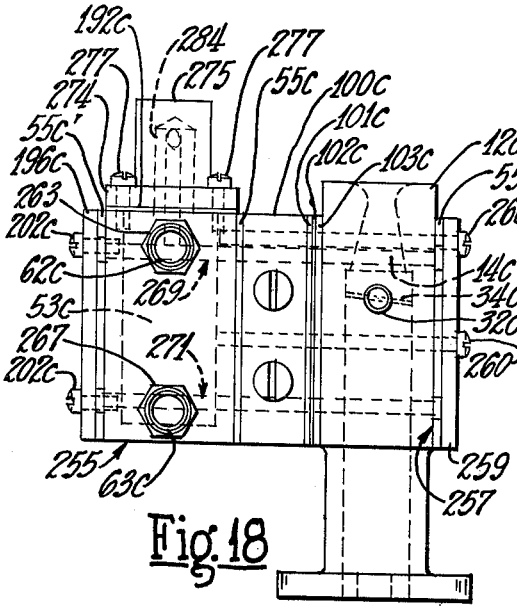
FIG. 18 is a side elevational view similar to FIG. 1 of a carburetor construction embodying three heat-exchanger fluid circuit laminates.
Figure 19:
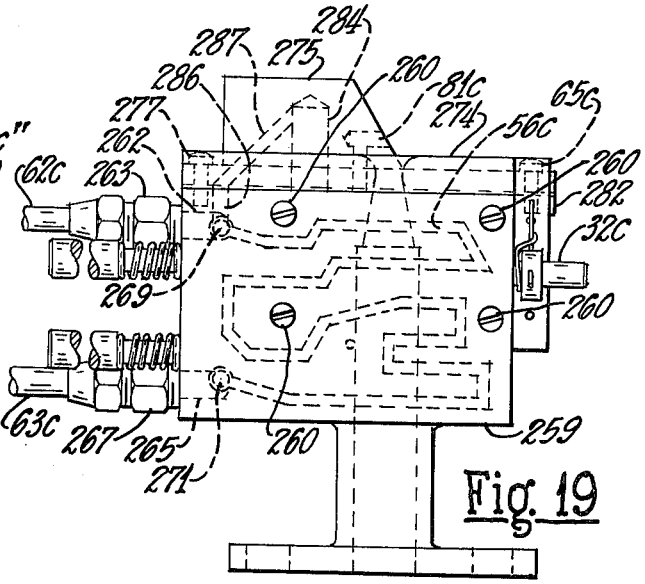
FIG. 19 is a front view of the arrangement shown in FIG. 18.

FIGS. 18 and 19 illustrate a carburetor construction of the general character shown in FIGS. 12 and 13 with an additional heat-transfer laminate associated with the body or body member **12*c* of the carburetor containing the mixture passage 14*c*, the fuel delivery orifices or apertures and the throttle valve 34*c* mounted on a throttle shaft 32*c*. Several of the carburetor components may be substantially the same as the corresponding components of the carburetor illustrated in FIGS. 12 and 13**.

The heat-transfer or heat-exchanger laminates **55*c*, 55*c*′, and the laminates 100*c*, 101*c*, 102*c* and 103*c* are similar to the corresponding laminates illustrated in FIGS. 12 and 13. The body or bowl member 255, which contains the fuel chamber 53*c*, is similar to the body or bowl member 190** but differs in certain respects hereinafter described.

The heat-transfer laminate **55*c* is disposed in contiguous sealing relation with one side wall surface of the bowl member 255, and the heat-transfer laminate member 55*c*′ is disposed in contiguous sealing relation with the opposite side wall surface of the member 255. A plate 196*c* is disposed in contiguous engagement with the heat-transfer laminate 55*c*′, the latter and the plate 196*c* being secured to the body or bowl member 255 by screws 202*c*. The heat-transfer laminates 55*c* and 55*c*′ are fashioned with circuitous channels of the character shown at 56 in FIG. 10**.

In the arrangement shown in FIGS. 18 and 19, a third heat-transfer or heat-exchanger laminate or member **55*c*″ is disposed in contiguous sealing engagement with a flat or planar surface 257 at the right side of the body 12*c* as viewed in FIG. 18. The heat-transfer laminate 55*c*″ is provided with an elongated open area or channel 56*c* of the same configuration as shown at 56 in the heat-transfer laminate 55 illustrated in FIG. 10. A plate 259 of the same character as the plate 196*c* is in contiguous sealing relation with the heat-transfer laminate 55*c*″**.

Screws 260 extend through aligned openings in the plate 259, heat transfer laminate **55*c*″, body 12*c*, laminates 100*c* through 103*c* and heat transfer laminate 55*c*, the screws extending into threaded openings in the wall of the body or bowl member 255 adjacent the heat transfer laminate 55*c*, the screws 260 securing these components and laminates in assembled relation as shown in FIG. 18. The bowl member 255 is provided in an end region with a threaded bore 262 which receives an inlet fitting 263 connected with the fuel supply line 62*c*** which is connected with a fuel pump.

The bowl member 255 is fashioned with a second threaded bore 265 which receives an outlet fitting 267 connected with the fuel return line **63*c* which returns circulating fuel to the fuel tank 58 shown schematically in FIG. 1. The bowl member 255 is provided with a transverse passage 269 in communication with the threaded bore 262 which receives the fuel inlet fitting 263. The bowl member 255 is provided with a second transverse passage 271 which is in communication with the bore 265, the latter accommodating the fitting 267 connected with the fuel return line 63*c***.

Circulating fuel entering the bore 262 in the bowl member 255 flows in opposite directions in the transverse passage 269 whereby fuel is supplied to the upper ends of the circulating fuel channels in heat-transfer laminates **55*c*, 55*c*′ and 55*c*″. The laminates 100*c*, 101*c*, 102*c* and 103*c* and the body 12*c* are fashioned with aligned openings or passages forming a continuation of the transverse passage 269 whereby fuel from the transverse passage 269 flows into and circulates in the channel 56*c* in the heat-transfer laminate 55*c*″**.

The laminates **100*c*, 101*c*, 102*c* and 103*c* and the body 12*c* are also fashioned with aligned openings or passages providing a continuation of the transverse passage 271 whereby fuel, after flowing through the channel 56*c* in the heat-transfer laminate 55*c*″, flows into passage 271 thence through the bore 265, fitting 267 and fuel return line 63*c* into the fuel tank shown schematically at 58 in FIG. 1. Thus, fuel is continuously concomitantly circulated through the fuel channels in each of the heat-transfer laminates 55*c*, 55*c*′ and 55*c*″** to convey heat away from the carburetor construction.

Incoming fuel from the fuel line **62*c* is supplied to the fuel chamber 53*c* in the bowl member 255 from the threaded bore 262. The bowl cover 274 has a boss portion 275 of shorter length than the boss portion 67 shown in FIGS. 3 and 4 so as to provide for two screws 277 which extend through openings in the cover 274 and gasket 192*c* into threaded bores in the bowl member 255 for securing one end of the cover 274 to the bowl member 255. The opposite end region of the cover 274 is secured to the bowl member by a screw 65*c* extending through openings in the cover member and gasket 192*c* into a threaded bore in a projection 282 on the member 255**.

The boss portion 275 is fashioned with a vertical bore 284 in which is disposed a fuel inlet control valve of the character shown in FIG. 9, the inlet valve being controlled by a float member 79 shown in FIG. 9. The fuel chamber 53c is vented through a vent passage 81c in the boss 275. The bowl member 255 has a vertically arranged passage 286 which is in communication through an opening in the gasket 192c with an angularly-arranged passage 287 in the boss portion 275, the angularly-arranged passage opening into the vertical bore 284.

Thus, fuel is supplied to the float bowl or chamber 53c from the bore 262 through passages 286 and 287 to the bore 284 containing the inlet valve means of the character shown in FIG. 9 for maintaining fuel in the chamber 53c. It will be noted that the circulatory paths for the continuous circulation of liquid fuel through the channels in the laminates 55c, 55c' and 55c'' are independent of the passages conveying fuel to the bowl 53c which supplies the fuel requirements for the engine.

In the arrangement shown in FIGS. 18 and 19, the continuously circulating liquid fuel through the channels in the heat-transfer laminates 55c, 55c' and 55c'' convey away heat from both body members or sections 12c and 255 and the associated components so as to maintain the liquid fuel in the chamber 53c and in the various passages supplying fuel to the mixing passage at a comparatively low temperature to reduce the tendency for "vapor lock" to occur.

Figure 20:
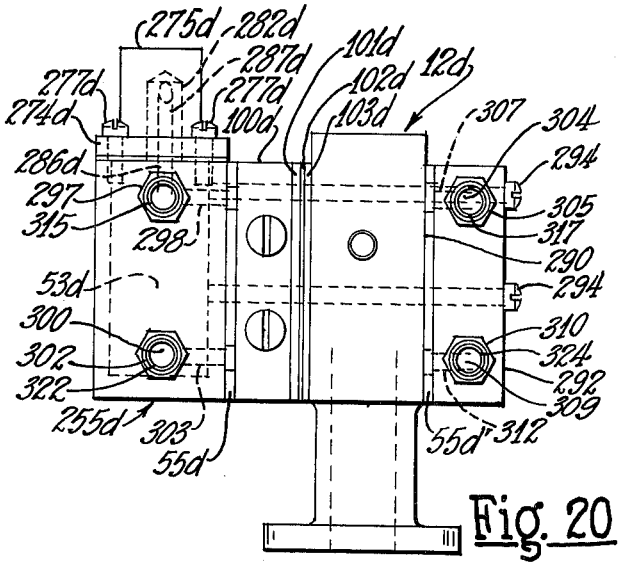
FIG. 20 is an elevational view similar to FIG. 15 illustrating a modified arrangement of heat-exchanger construction.
Figure 21:
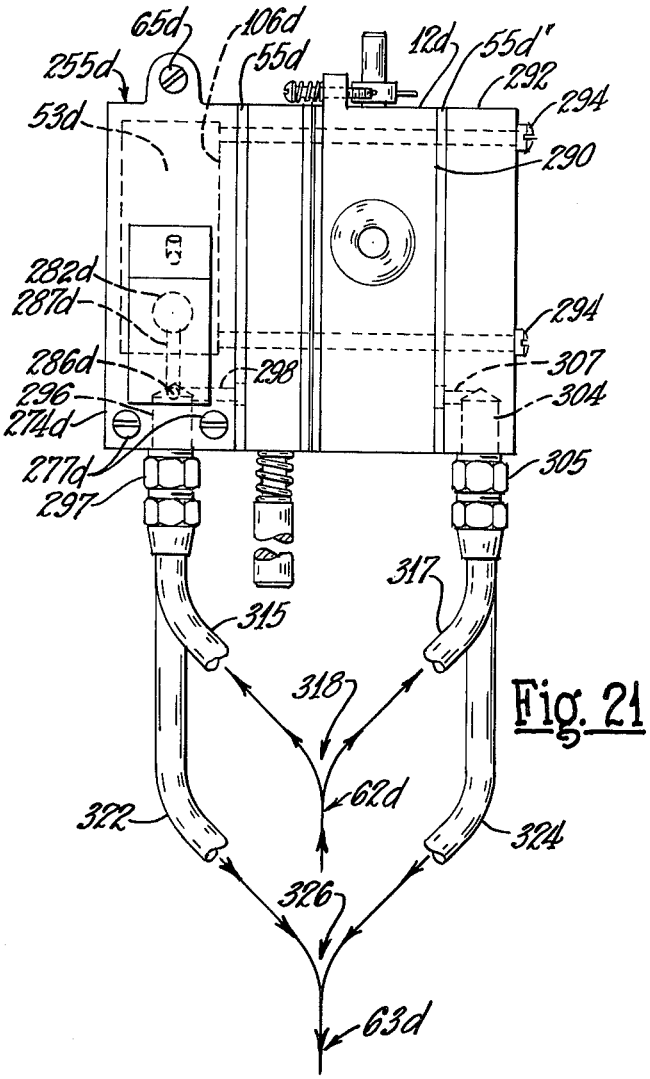
FIG. 21 is a top plan view of the construction shown in FIG. 20.

FIGS. 20 and 21 illustrate a carburetor construction of the general character shown in FIG. 18 illustrating one heat-exchanger laminate associated with the fuel bowl or body member and a heat-exchanger laminate for association with the carburetor body member providing the fuel and air mixing passage. In the arrangement shown in FIGS. 20 and 21, a single fuel inlet line from the fuel pump is provided with a Y connection to supply circulating fuel to the two heat-exchanger laminates and separate outlets provided for the circulating fuel from the heat-exchanger laminates joined by a Y connection into a single fuel return line to the fuel tank.

The body 12d, the laminates 100d, 101d, 102d, 103d, the heat-exchanger laminate 55d, the body or fuel bowl member 255d and the cover member 274d having a boss 275d are of substantially the same construction as the corresponding components illustrated in FIG. 18 and hereinbefore described.

A heat-exchanger laminate 55d' of the same configuration as the laminate 55d is disposed contiguous with a planar wall surface 290 of the body or body member 12d. Disposed in contiguous engaging relation with the heat-exchanger laminate 55d' is a plate, member or laminate 292. A wall 106d of the bowl member 255d is provided with threaded openings to receive four securing screws 294. The screws 294 extend through four groups of aligned openings in the body 12d and the laminates so that these components are held in assembled fluid-tight relation.

The cover member 274d is secured at one end region to the bowl member 255d by a screw 65d, and is secured to the bowl member at the other end region by screws 277d extending into threaded openings in the bowl member as in the arrangement shown in FIGS. 18 and 19. An upper end region of the bowl member or body 255d is provided with a threaded bore 296 which accommodates a threaded portion of a fitting or coupling 297. The bore 296 is in communication with a short horizontal passage 298 which registers with one end region of the circuitous fuel circulating channel in the heat exchanger laminate 55d.

The bore 296 is in communication with a vertical passage 286d communicating with an angular passage 287d in the boss 275d, the upper end of the passage 287d opening into the threaded bore 282d, the latter accommodating the fuel inlet valve arrangement of the character illustrated in FIG. 9 for regulating fuel flow into the fuel chamber 53d in the bowl member 255d.

The bowl member 255d is provided with a second threaded bore 300 in which is mounted an outlet fitting 302. The bowl member 255d has a second short passage 303 establishing communication between the threaded bore 300 and the other end region of the fuel circulating channel in the heat-exchanger laminate 55d.

The member or laminate 292 has a threaded bore 304 which accommodates a threaded fitting 305. The member or laminate 292 is fashioned with a short transverse passage 307 establishing communication of the bore 304 and an end region of a fuel circulating channel in the heat-exchanger laminate 55d'. The laminate 292 is provided with a second threaded bore 309 in which is mounted a threaded fitting 310.

The laminate 292 has a second short passage 312 establishing communication between the threaded bore 309 and the other end of the fuel circulating channel in the heat-exchange laminate 55d'. Connected with the fitting 297 is a fuel inlet pipe 315 and connected with the fitting 305 is a fuel inlet pipe 317. The pipes 315 and 317 are joined in a Y connection or coupling 318 indicated schematically in FIG. 21 which joins the pipes 315 and 317 in a single fuel supply line or pipe 62d which is connected with a fuel pump indicated at 60 in FIG. 1.

A fuel return pipe 322 is connected with the outlet fitting 302 mounted by the bowl member 255d and a fuel return pipe 324 is connected with the outlet fitting 310 mounted by the laminate 292. The pipes 322 and 324 are joined by a Y connection or coupling 326, indicated schematically in FIG. 21, the connection or coupling joining the pipes into a single fuel return line or pipe 63d which is connected with and returns the circulating fuel to the fuel tank indicated schematically at 58 in FIG. 1.

The excess fuel delivered from the fuel pump is divided by the Y connection 318 whereby a portion of the fuel is delivered through the pipe or line 315 into the inlet passage or bore 296. Fuel from the bore 296 is conveyed by passages 286d, 287d to the float-controlled inlet valve mechanism in the chamber 53d for supplying the fuel requirements for the engine. Another portion of the fuel in the bore 296 flows through passage 298 through the fuel circulating channel in the heat exchanger laminate 55d, thence through the passage 303 into the outlet passage or bore 300 through the outlet fitting 302.

A portion of the fuel from the fuel pump flows through the pipe or line 317, fitting 305 into the inlet passage or bore 304, thence through the passage 307 and through the circulating channel in the heat transfer laminate 55d'. The fuel circulates through the channel to the other end of the channel and flows through the short passage 312 into the outlet passage or bore 309 and through the fitting 310 to a return fuel pipe 324. The fuel flowing in pipes 322 and 324 is directed through the Y connection 326 into the single fuel line 63d which returns the circulating fuel to the fuel tank.

As the fuel line or pipe 315 provides fuel for the engine requirements and fuel for circulation through the channel in the heat-exchanger laminate 55d, the amount of fuel flowing through the pipe 315 may be greater than the amount of fuel flowing through pipe 317. However, sufficient excess fuel is provided by the fuel pump to continuously flow liquid fuel through the channels in the heat-exchanger laminates 55*d* and 55*d'* and convey away heat by the circulating fuel to eliminate or substantially reduce the tendency for the fuel in the chamber 53*d* to vaporize and form "vapor lock".

It is to be understood that the fluid circulating unit comprising the laminate 292, the heat-transfer or heat-exchanger laminate 55*d'* and the inlet and outlet fittings 305 and 310 may be employed as an individual cooling unit and may be secured to any flat surface of a carburetor component or body construction for conveying away heat by circulating fluid.

It is apparent that, within the scope of the invention, modifications and different arrangements may be made other than as herein disclosed, and the present disclosure is illustrative merely, the invention comprehending all variations thereof.

I claim:

1. Charge forming apparatus including, in combination, a body construction having a fuel and air mixing passage, aperture means for discharging fuel into the mixing passage, a fuel chamber in the body construction, passages in the body construction for conveying fuel from the fuel chamber to the aperture means, means associated with the fuel chamber for regulating flow of liquid fuel into the fuel chamber, means for conveying fuel under pressure from a supply through an inlet passage to the fuel flow regulating means, a heat exchanger member secured to said body construction in heat-transferring relation with a surface of the body construction, said heat exchanger member having an elongated fuel circulating channel therein, the channel in the heat exchanger member being a perforate region of undulated configuration, passage means for delivering fuel from the inlet passage to the channel in said heat exchanger member, a fuel outlet passage in communication with the channel, and means connected with the outlet passage for returning fuel circulating in said channel to the fuel supply.

2. Charge forming apparatus including, in combination, a body construction having a fuel and air mixing passage, aperture means for discharging fuel into the mixing passage, a fuel chamber in the body construction, passages in the body construction for conveying fuel from the fuel chamber to the aperture means, means associated with the fuel chamber for regulating flow of liquid fuel into the fuel chamber, means for conveying fuel under pressure from a supply through an inlet passage to the fuel flow regulating means, a heat exchanger member secured to said body construction in heat-transferring relation with a surface of the body construction, said heat exchanger member being a planar laminate having an elongated fuel circulating channel therein, passage means for delivering fuel from the inlet passage to the channel in said heat exchanger member, a fuel outlet passage in communication with the channel, and means connected with the outlet passage for returning fuel circulating in said channel to the fuel supply.

3. Charge forming apparatus including, in combination, a body construction having a fuel and air mixing passage, aperture means for discharging fuel into the mixing passage, a fuel chamber in the body construction, passages in the body construction for conveying fuel from the fuel chamber to the aperture means, means associated with the fuel chamber for regulating flow of liquid fuel into the fuel chamber, means for conveying fuel under pressure from a supply through an inlet passage to the fuel flow regulating means, a heat exchanger member secured to said body construction in heat-transferring relation with a surface of the body construction, said heat exchanger member being of gasket material having an elongated fuel circulating channel therein, passage means for delivering fuel from the inlet passage to the channel in said heat exchanger member, a fuel outlet passage in communication with the channel, and means connected with the outlet passage for returning fuel circulating in said channel to the fuel supply.

4. Charge forming apparatus, in combination, a body construction, said body construction including a first body section and a second body section, a fuel and air mixing passage in one body section, a fuel chamber in the other body section, aperture means for discharging fuel into the mixing passage, passages in the body construction for conveying fuel from the fuel chamber to the aperture means, means associated with the fuel chamber for regulating flow of liquid fuel into the fuel chamber, a cover member for the body section providing the fuel chamber, said fuel flow regulating means being mounted by the cover member, a fuel inlet passage in the cover member, means for conveying fuel under pressure from a supply to the fuel flow regulating means, a heat exchanger member secured to said body construction in heat-transferring relation with a surface of the body construction, said heat exchanger member having an elongated fuel circulating channel therein, passage means for delivering fuel from the inlet passage to the channel in said heat exchanger member, a fuel outlet passage in communication with the channel, said fuel outlet passage being in the body section providing the fuel chamber, and means connected with the outlet passage for returning fuel circulating in said channel to the fuel supply.

5. Charge forming apparatus according to claim 2 wherein the body construction includes a first body section and a second body section, the fuel and air mixing passage being in one body section, and the fuel chamber being in the other body section, the fuel inlet passage and fuel outlet passage being in the body section provided with the fuel chamber.

6. Charge forming apparatus according to claim 2 including a second heat exchanger member having an elongated fuel circulating channel therein in heat-transferring relation with another surface of the body construction, means in the body construction for conveying fuel from the inlet passage to the channel in said second heat exchanger member, and means in said body construction in communication with the channel in said second heat exchanger member and said outlet passage for returning fuel circulating in the channel in said second heat exchanger member to the outlet passage.

7. Charge forming apparatus according to claim 2 wherein the body construction includes a first body section and a second body section, the fuel and air mixing passage being in the first body section, the fuel chamber being in the second body section, the heat exchanger member being in contiguous heat-transferring relation with one surface of the second body section, a second heat exchanger member in contiguous heat-transferring relation with another surface of the second body section, a fuel circulating channel in the second heat exchanger member, and means in the second body section establishing communication between the fuel channel in the second heat exchanger member and the fuel inlet and outlet passages.

8. Charge forming apparatus, in combination, a body construction, said body construction including a first body section and a second body section, a fuel and air mixing passage in the first body section, a fuel chamber in the second body section, aperture means for discharging fuel into the mixing passage, a fuel chamber in the body construction, passages in the body construction, means associated with the fuel chamber for regulating flow of liquid fuel into the fuel chamber, means for conveying fuel under pressure from a supply through an inlet passage to the fuel flow regulating means, a heat exchanger member secured to said body construction, said heat exchanger member being in contiguous heat-transferring relation with a surface of the second body member, said heat exchanger member having an elongated fuel circulating channel therein, passage means for delivering fuel from the inlet passage to the channel in said heat exchanger member, a fuel outlet passage in communication with the channel, a plurality of laminar members disposed between the heat exchanger member and the first body section, said laminar members and the heat exchanger member having perforate regions in communication with the passages in the body construction for conveying fuel from the fuel chamber to the aperture means, means securing the body sections, the laminar members and the heat exchanger member in assembled relation, and means connected with the outlet passage for returning fuel circulating in said channel to the fuel supply.

9. Charge forming apparatus according to claim 2 wherein the body construction includes a first body section and a second body section, the fuel and air mixing passage being in the first body section, the fuel chamber being in the second body section, the heat exchanger member being in heat-transferring relation with the second body section, a second heat exchanger member having a fuel circulating channel therein in heat-transferring relation with the first body section, a laminate in contiguous engagement with the second heat exchanger member, the fuel inlet passage and the fuel outlet passage being in the second body section providing the fuel chamber, said inlet and outlet passages being in communication with the fuel circulating channels in the heat exchanger members.

10. Charge forming apparatus according to claim 2 wherein the body construction includes a first body section and a second body section, the fuel and air mixing passage being in the first body section, the fuel chamber being in the second body section, the heat exchanger member being in heat-transferring relation with the second body section, a second heat exchanger member having a fuel circulating channel therein in heat-transferring relation with the first body section, a laminate in contiguous engagement with the second heat exchanger member, the fuel inlet passage and the fuel outlet passage being in communication with the fuel circulating channal in the first heat exchanger member, and second fuel inlet and outlet passages in said laminate in communication with the fuel circulating channel in the second heat exchanger member.

11. Charge forming apparatus including, in combination, a body construction having a first body section and a second body section, a fuel and air mixing passage in the first body section, aperture means for delivering fuel into the mixing passage, said second body section having a fuel chamber, means associated with the fuel chamber for regulating fuel flow into the chamber, a cover member for the fuel chamber having a fuel inlet passage, a heat exchanger laminate in contiguous relation with a surface of the second body section, a plurality of laminar members disposed between the heat exchanger laminate and the first body section, means securing the body sections, the laminar members and the heat exchanger laminate in assembled relation, said laminar members and heat exchanger laminate having perforate regions through which fuel flows from the fuel chamber to the orifice means, said heat exchanger laminate having an elongated channel therein spaced from the perforate regions, said fuel inlet passage adapted to receive fuel under pressure from a supply, means in communication with the fuel inlet passage for conveying fuel to one end region of the channel in the heat exchanger laminate, and a fuel outlet passage in said second body section in communication with the other end region of the channel in the heat exchanger laminate, said outlet passage adapted to be connected with means for returning circulating fuel from the channel to the fuel supply.

12. A fuel system for an internal combustion engine including charge forming apparatus and a fuel supply therefor, said charge forming apparatus having a body construction providing a fuel bowl, means associated with said fuel bowl for regulating fuel flow into the fuel bowl, a fuel pump connected with the fuel supply and adapted to pump fuel in excess of the fuel requirements for the engine, a heat exchanger laminar member secured to the body construction in heat-transferring relation therewith, said heat exchanger laminar member having a fuel circulating channel therein, means conveying fuel from the fuel pump to the fuel bowl and to the channel in the heat exchanger laminar member, and means establishing communication between the channel in said heat exchanger laminar member and the fuel supply for continuously returning circulating fuel in said channel to the fuel supply during operation of the fuel pump.

13. A fuel system for an internal combustion engine including charge forming apparatus and a supply of liquid fuel therefor, said charge forming apparatus having a body construction providing a fuel bowl, means associated with said fuel bowl for regulating fuel flow into the fuel bowl, a fuel pump connected with the fuel supply and adapted to pump fuel in excess of the fuel requirements for the engine, a plurality of heat exchanger laminar members secured to the body construction in heat-transferring relation therewith, each of said heat exchanger members having a fuel circulating channel therein, means conveying fuel from the fuel pump to the fuel bowl and to the channels in the heat exchanger laminar members, and means establishing communication of the channels in said heat exchanger laminar members with the fuel supply for returning fuel circulating in each of said channels to the fuel supply during operation of the fuel pump.

14. A fuel system for an internal combustion engine including charge forming apparatus and a supply of liquid fuel therefor, said charge forming apparatus having a body construction providing a fuel bowl, means associated with the fuel bowl for regulating fuel flow into the fuel bowl, a fuel pump connected with the fuel supply and adapted to pump fuel in excess of the fuel requirements for the engine, a heat exchanger means for the charge forming apparatus, said heat exchanger means including a heat exchanger laminar member having an open area providing an elongated fuel circulating channel, one major surface of the laminar member being in contiguous heat-transferring relation with a surface of the body construction, a laminate engaging the other major surface of the laminar member, means conveying fuel from the fuel pump to the fuel bowl and to the channel in the laminar member, and means establishing communication between the channel in the laminar member and the fuel supply for returning fuel circulating in said channel to the fuel supply during operation of the fuel pump.

15. A fuel system including charge forming apparatus comprising a body construction having a fuel bowl adapted to be supplied with liquid fuel from a supply, fuel passage means in said body construction, means associated with said fuel bowl for regulating fuel flow from the passage means into the fuel bowl, said passage means adapted to receive liquid fuel under pressure from the supply, a heat exchanger means including a laminar member secured to the body construction and in heat-transferring relation therewith, said laminar member having an undulated fuel circulating channel, said passage means being in communication with one end of said channel for conveying fuel from the passage means into the channel, and fuel conveying means in communication with the other end of the channel and the fuel supply for returning circulating fuel from the channel to the fuel supply.

16. Charge forming apparatus according to claim 6 including a third heat exchanger member having an elongated fuel circulating channel therein in heat transferring relation with a third surface of the body construction.

17. Charge forming apparatus according to claim 16 including means in the body construction for conveying fuel from the first passage means to the channel in the third heat exchanger member, and means in communication with the outlet passage and the channel in the third heat exchanger member for returning circulating fuel from the channel in the third heat exchanger member to the outlet passage.

18. The combination according to claim 1 wherein the heat exchanger member is of substantial thickness and has the elongated fuel channel in one surface region thereof, said channel being of a depth approximately the same as its width, the surface of the heat exchanger member provided with the elongated channel being in heat-transferring relation with the body construction.

19. The combination according to claim 18 wherein the heat exchanger member is of resinous material.

20. The combination according to claim 19 wherein the heat exchanger member has an opening therein and a transverse passage in communication with the opening accommodating fuel flow from the fuel chamber to the orifice means, said opening having a threaded portion, a valve member extending into the opening and having a threaded body portion cooperating with the threaded portion of the opening, said valve member having a tenon portion and a needle valve portion, said valve member being adjustable for controlling fuel flow to the orifice means, and a portion of the opening having inwardly extending projections snugly engaging the tenon portion of the valve means for guiding the tenon portion.

21. Charge forming apparatus including, in combination, a body construction having a fuel and air mixing passage and a fuel chamber, aperture means for discharging fuel from the fuel chamber into the mixing passage, said body construction having a planar surface, a planar heat exchanger member having a fuel circulating channel therein, said heat exchanger member being in contiguous heat-transferring relation with the planar surface of the body construction, a laminate in contiguous engagement with the heat exchanger member, fuel inlet and outlet passages in said laminate, said fuel inlet and outlet passages being in communication with the fuel circulating channel in the heat exchanger member, and means securing said body construction, heat exchanger member and laminate in assembled relation.

* * * * *